US005990841A

United States Patent [19]

Sakamoto et al.

[11] Patent Number: 5,990,841

[45] Date of Patent: Nov. 23, 1999

[54] WIDE-BAND ANTENNA AND TUNING METHOD

[75] Inventors: Yoshio Sakamoto; Yoshitsune Iitsuka; Makoto Yamaguchi, all of Tokyo, Japan

[73] Assignee: Yaesu Musen Co., Ltd., Tokyo, Japan

[21] Appl. No.: 09/124,336

[22] Filed: Jul. 28, 1998

[30] Foreign Application Priority Data

| | | | |
|---|---|---|---|
| Aug. 27, 1997 | [JP] | Japan | 9-008056 U |
| Aug. 27, 1997 | [JP] | Japan | 8-008058 U |
| Aug. 27, 1997 | [JP] | Japan | 9-008059 U |
| Aug. 27, 1997 | [JP] | Japan | 9-008060 U |
| Aug. 27, 1997 | [JP] | Japan | 9-008061 U |
| Aug. 27, 1997 | [JP] | Japan | 9-008062 U |
| Aug. 27, 1997 | [JP] | Japan | 9-244882 |
| Aug. 29, 1997 | [JP] | Japan | 9-008173 U |

[51] Int. Cl.[6] ..... H01Q 9/00

[52] U.S. Cl. ..... 343/749; 343/750; 343/901

[58] Field of Search ..... 343/702, 715, 343/745, 749, 750, 895, 900, 901, 872

[56] References Cited

U.S. PATENT DOCUMENTS

| | | | |
|---|---|---|---|
| 2,781,514 | 2/1957 | Sichak et al. | 343/895 |
| 2,854,667 | 9/1958 | Taylor et al. | 343/750 |
| 5,164,739 | 11/1992 | Koide et al. | 343/749 |

OTHER PUBLICATIONS

"Model HS–1500" and "Model HS–1600" placed on the market by High Sierra Antenna (Date and pages are not provided).

"BB–3" put on the market by T. J. Antenna Company.

*Primary Examiner*—Don Wong
*Assistant Examiner*—Tan Ho
*Attorney, Agent, or Firm*—Pillsbury Madison & Sutro LLP

[57] ABSTRACT

An antenna that comprises a rod, a movable coil, and a holding section which holds the movable coil in a manner that allows the movable coil to slide in and out of the holding section. When the movable coil is drawn into the holding section, the holding section tunes to a particular desired frequencies in the upper portion of the VHF band and the UHF band; for example, 144 MHz and 430 MHz. When the movable coil is out of the holding section, the holding section, the rod, and the portion of the movable coil outside the holding section form antenna element of a center-loading type that tunes to frequencies in the HF band and the lower portion of the VHF band; for example, frequencies in the range of 3MHz to 50MHz. The tuning frequency is varied by sliding the position of the coil.

23 Claims, 13 Drawing Sheets

| TARGET FREQUENCY | SHIFT AMOUNT |
|---|---|
| 430MHz | 0cm |
| 144MHz | 0cm |
| 50MHz | 3cm |
| 28MHz | 5cm |
| 21MHz | 8cm |
| 14MHz | 12cm |
| 7MHz | 18cm |
| 3.5MHz | 23cm |

WIDE-BAND ANTENNA AND TUNING METHOD

BACKGROUND OF THE INVENTION

1. Field of the Invention

The present invention relates to a wide-band antenna, and more particularly to a wide-band antenna which is tunable to a plurality of frequency bands.

2. Brief Description of the Related Art

Antennas are used in a wide variety of applications to receive signals. For example, antennas are used to receive and transmit signals for AM/FM radios, short-wave radios, walkie-talkies, television, cordless telephones, etc. Each antenna, however, must be designed to receive signals in a particular frequency band. Conventional antennas typically use a single loading coil in order to uniquely tune to signals within the band for which it is designed to operate. In order for the antenna to receive signals out of the range for which it was constructed for, a different loading coil capable of tuning to a different frequency band must be used. Thus, conventional antennas are limited in that they can only tune to signals within a certain range and additional tuning elements must be carried and used by the antenna in order for it to be able to tune to signals outside of the frequency bands for which they were designed to operate.

Some standardized frequency bands used by antennas include the High Frequency band (HF), the Very High Frequency band (VHF), and the Ultra High Frequency band (UHF). The HF band generally ranges from 3 to 30 MHz. The VHF band generally ranges from 30 to 300 MHz. And, the UHF band generally ranges from 300 to 3000 MHz. Several conventional antennas have been manufactured for tuning to signals within the frequency band of 3 MHz to 50 MHz, which covers the entire HF range and overlaps with the lower frequencies of the VHF band. For example, the MODEL HS-1000™, manufactured by HIGH SIERRA ANTENNA™ can tune to the frequency from 3.5 MHz to 30 MHz. Also, the BB-3® antenna, manufactured by T. J. ANTENNA COMPANY™, can tune to the frequency band ranging from 3.5 MHz to 54 MHz. However, these antennas cannot tune to any signals in the upper frequency range of the VHF band and to frequencies in the Ultra High Frequency (UHF) band without additional loading coils designed for those frequencies. Two such frequencies would be, for example, 144 MHz and 430 MHz, respectively. Ability to receive these two higher frequencies is often desirable for an antenna since these two frequencies are popular frequencies for radio communications. However, to receive and transmit the signals of these frequencies, an antenna for these frequencies must be additionally prepared or the loading coils replaced on the antenna.

Moreover, the kinds of antennas tunable to the higher frequencies typically use a variable coil and a rod to reach the higher frequencies. The problem with variable coils, however, is the creation of inductance by the unused sections of the variable coil. The inductance tends to shift the tuning frequency. The effect on tuning is much worse in higher frequencies than lower frequencies. Thus, not only is the ease of use of such conventional antennas poor for receiving and transmitting higher frequencies (i. e. resulting in inconvenience for the users of such antennas), proper tuning on higher frequencies often cannot be performed with prior antennas.

SUMMARY OF THE INVENTION

Accordingly, it is an object of the present invention, which comprises an antenna and method for tuning the antenna, to remedy the above-mentioned deficiencies. The present invention provides for a wide-band antenna that not only continuously tunes to signals in the HF and the lower portion of VHF band, but also can, without having to use replacement loading coils, tune to an additional frequency in the upper portion of the VHF band and additional frequencies in the UHF band.

An antenna in accordance with one embodiment of the present invention comprises a rod, a movable coil connected to the rod, and a holding section. The holding section holds the movable coil in a manner that allows the movable coil to slide in and out of the holding section. The movable coil is connected electrically to the holding section at a point inside the upper end of the holding section called the contacting section.

According to an embodiment of the invention, a driving section, controlled electrically by a tuning control section, slides or moves the movable coil out of the holding section. When the movable coil is out of the holding section, the rod, the portion of the movable coil outside of the holding section, and the holding section function as a center-loading type antenna. The portion of the movable coil outside of the holding section functions as a loading coil. The antenna is designed such that, when it is in this configuration, it tunes to signals having frequencies in the HF band and the lower portion of the VHF band. Signals lying in the 3 to 50 MHz frequency band are examples of such frequencies. To tune the antenna to a desired frequency within such a band, the tuning control section controls the driving section to slide the movable coil a specific amount out of the holding section. When the coil is slid, the inductance of the loading coil changes and the tuning frequency varies. Thus, the antenna, in the center-loading configuration, tunes to the desired frequency depending on how far the moving coil is slid outside the holding section.

The present invention can also tune to a frequency in the upper portion of the VHF band and to a frequency in the UHF band. When the movable coil slides inside the holding section, the higher frequencies will "see" increased impedance between the movable coil and the holding section. This high impedance separates, or electrically isolates, the movable coil from the holding section. Thus, the movable coil no longer functions as part of the antenna. When the loading coil is inside the holding section, the holding section by itself functions as the antenna. Therefore, by controlling the length of the holding section, the holding section can be used to receive a frequency in the upper portion of the VHF band and to frequencies in the UHF band. For example, the holding section is formed having a length which is substantially equal to ¼ of a wavelength of a signal whose frequency lies in a high frequency band included in the VHF band, and which is substantially equal to ⅝ of a wavelength of a signal whose frequency lies in a UHF band. The antenna is different from the conventional antenna in that it can tune to these additional frequencies without the use of replacement coils.

The movable coil can then be varied back to a position in which the loading coil is out of the holding section. The rod, the movable coil, and the holding section will again function as an antenna element of a center loading type, with the portion of the coil outside the holding section functioning as a loading coil. This configuration again will allow the antenna to receive signals with frequencies in the HF band and the lower portion of the VHF band. Therefore, the present invention provides for an antenna that can be continuously tuned to a plurality of different frequencies in the HF and lower portion of the VHF band. Additionally, it can be tuned to a signal in the upper part of VHF band and a signal in the UHF band without additional loading coils.

In another embodiment of the present invention, the tuning control section and driving section can be removed. With this embodiment, the user can tune the antenna to the desired frequency by manually sliding the movable coil in and out of the holding section.

In the preferred embodiment, the movable coil is made of a bobbin and a lead wire wound around the bobbin. In another preferred embodiment of the present invention, the loading coil of the antenna consists of sections that have the lead wire wound such that the windings around the bobbin are close together. These sections alternate with sections in which the lead wire is wound around the bobbin such that there is more space between the wound windings. This embodiment allows the antenna to be finely tuned to the desired frequency.

Another embodiment of the present invention features an antenna having a movable coil with grooves formed on the bobbin and the lead wire wound around the grooves. This embodiment allows for more uniformity in the diameter of the movable coil.

In yet another preferred embodiment, the contacting section of the antenna is not a point contact. The holding section is constructed such that the entire inner surface of the holding section is in contact with the movable coil. This embodiment has the advantage of providing more stability between the holding section and the movable coil.

Another embodiment of the present invention features a structure wherein the movable coil is slid out of the holding section by rotating the movable coil. This embodiment also allows for fine-tuning to a desired frequency.

Other features include mechanisms that restrict the range of the movable coil so that the movable coil cannot move too far out of the holding section. With such a restriction is also a circuit that controls the motor when the movable coil reaches its limits. This control function prevents a mechanical overload from occurring, which can damage of the antenna.

Yet other features of the present invention include having a structure which prevents water and moisture from coming into contact with the movable coil and the inside of the holding section.

The invention is defined in its fullest scope in the claims, and is described in detail below in its preferred embodiments.

DETAILED DESCRIPTION OF THE INVENTION

The present invention provides for an antenna that can send and receive signals having frequencies in the High Frequency (HF) and the lower portion of the Very High Frequency (VHF) band. Additionally, the antenna can also tune to signals in the upper portion of the VHF band and in the Ultra High Frequency (UHF) band without having to use additional replacement loading coils. For definitional purposes, the HF band spans from 3 to 30 MHz, the VHF band spans from 30 MHz to 300 MHz, and the UHF band spans from 300 MHz to 3000 MHz.

Figure 1:
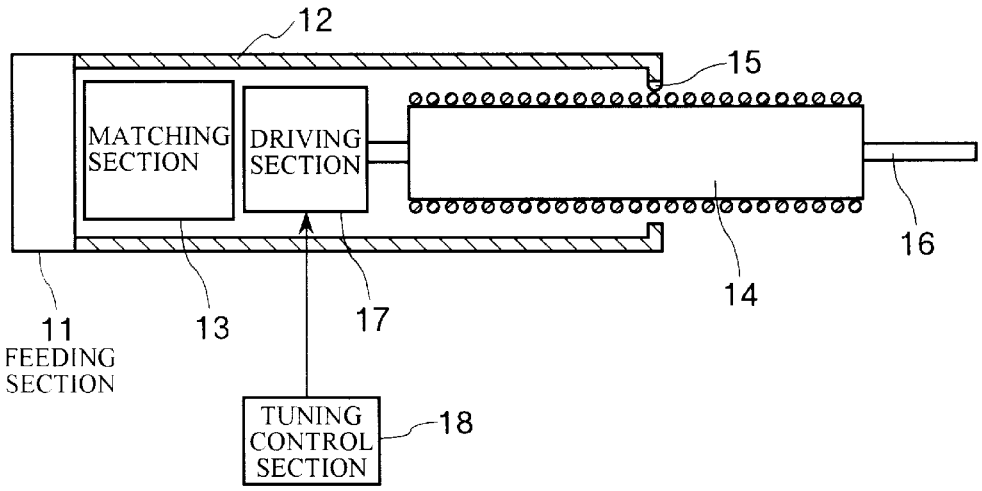
FIG. 1 is a cross section showing an antenna structure according to an embodiment of the present invention.

FIG. 1 is a view showing the structure of an antenna according to a first embodiment of the present invention. As shown in FIG. 1, the antenna comprises a feeding section 11, a holding section 12, a matching section 13, a movable coil 14, a contacting section 15, a rod 16, a driving section 17, and a tuning control section 18.

At the base of the antenna is the feeding section 11 which is attached to the holding section 12 on one end and connected to a radio communication device (not shown) by a coaxial connector on the other.

The holding section 12 is made up of a cylindrical conductive material, and slidably supports the movable coil 14. The holding section 12 is formed to have a length of about 50 cm. This length is nearly equal to ¼ (i.e., $\lambda/4$) of a wavelength ($\lambda$: about 2 m) of a signal whose frequency lies in a 144 MHz band (corresponding to a high frequency range included in the VHF band). This length is also nearly equal to ⅝ (i.e., $5\lambda/8$) of a wavelength (about 70 cm) of a signal whose frequency lies in a 430 MHz band (included in the UHF band). The holding section 12 functions as an antenna element for receiving and transmitting these radio waves.

The matching section 13 includes a matching coil and a capacitor. In order to lower a power loss, the matching section 13 matches the impedance of the antenna to the impedance, (e.g., 50Ω) of a coaxial cable connected to the feeding section 11 to optimize the standing wave ratio (SWR).

The movable coil 14 is used for loading. The movable coil 14 has a structure wherein uncoated lead wires (bare wires) **14*b* are wound around a bobbin 14*a* with a length of about 50 cm so that its inner-wire portions do not contact each other (see FIG. 5). The movable coil 14 is slidably supported by the holding section 12. The movable coil 14 is slid (in the rightward and leftward directions in FIGS. 1 and 2) so as to be moved into or out of the holding section 12 by the driving section 17. The contact between the movable coil 14 and the contacting section 15 changes in accordance with movement of the coil 14**.

The contacting section 15, which is made of a conductive material, is placed at an end of the holding section 12. The contacting section 15 is urged by e.g., a spring so that the section 15 comes into contact with the movable coil 14. The rod 16 is attached to an end of the bobbin 14*a* and is connected to an end of the lead wire 14*b* so as to emit or receive waves.

The driving section 17 comprises a motor, a converting section for converting rotation of the motor to linear motion, and a transmitting section for transmitting the linear motion to the movable coil 14. The driving section 17 slides the movable coil 14.

The tuning control section 18 includes an MPU (Micro Processor Unit). The control section 18 controls the driving section 17 to slide the movable coil 14 so as to obtain suitable inductance according to an operation frequency (i.e. transmitting frequency/receiving frequency).

Illustratively, the antenna is set to receive and transmit signals in the 144 MHz band (corresponding to the high frequency range included in the VHF band) or in the 430 MHz band (corresponding to a frequency in the UHF band). As seen in FIG. 1, the tuning control section 18 controls the driving section 17 to move the movable coil 14 inside the holding section 12. Since the operation frequency is high, the inductance of the coil that connects the rod 16 to the contacting section 15, is also high. Consequently, the loading coil (i.e. the rod 16 and the portion of movable coil 14 outside the holding section 12) is substantially isolated from the holding section 12. Moreover, the inductance of that portion of the movable coil 14 which is held inside the holding section 12 has no influence on tuning. Thus, in this closed configuration, the holding section 12 alone functions as an antenna.

For the holding section 12 to function as an antenna that can tune to signals in the upper portion of the VHF band, and also tune to signals in the UHF band, the holding section 12 is constructed so that its length corresponds to a multiple of ⅛ of the wavelength of the desired frequencies. In other words, the holding section 12 has a length substantially equal to m times of ⅛ of the wavelength of a frequency in the VHF band, and n times of ⅛ of the wavelength of a frequency in the UHF band, where m and n are different natural numbers.

For example, to receive a 144 MHz signal, which has a wavelength $\lambda$ of approximately 2 meters, the holding section 12 is constructed to have a length of about 50 cm, which is nearly equal to $\lambda/4$ for the 144 MHz signal (i.e. m=2). In addition, a holding section 12 with a length of 50 cm can also receive signals in the UHF range. For example, a holding section 12 with a length of about 50 cm can tune to a frequency of 430 MHz, which has a wavelength $\lambda$ of 70 cm, where 50 cm corresponds to $5\lambda/8$ (i.e. n=5). Thus, the holding section 12 with the length of about 50 cm functions as an antenna element when receiving and transmitting signals whose frequencies lie in the 144 MHz band and the 430 MHz band.

Figure 2:
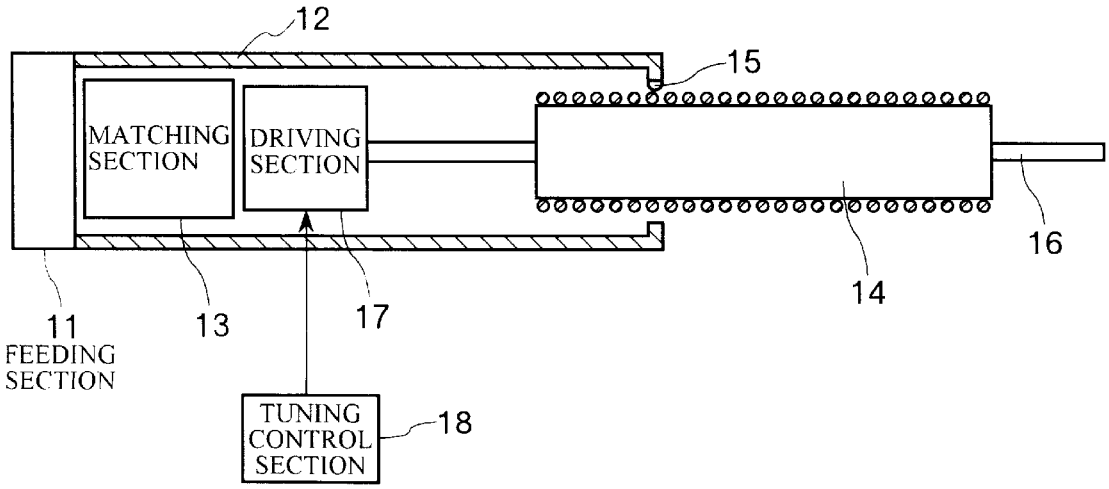
FIG. 2 is a cross section showing a state in which a movable coil is drawn from a holding section of the antenna of FIG. 1.

On the other hand, in receiving and transmitting signals whose frequencies lie in a range extending from the lower limit of the HF band (e.g., a 3.5 MHz) to the VHF band (e.g., 28 MHz and/or 50 MHz) the tuning control section 18 operates as described below with reference to FIG. 2:

Specifically, the tuning control section 18 controls the driving section 17 such that the movable coil 14 is pulled out of the holding section 12 as shown in FIG. 2. Thereby, the portion of the coil 14 that is pulled out of the holding section 12 is electrically connected in series between the holding section 12 and the rod 16. That portion of the coil 14 which is located outside of the holding section 12 functions as a loading coil. Thus, there is formed an antenna element of a center loading type having the rod 16, the movable coil 14, and the holding section 12. The tuning control section 18 controls the amount of the slide/movement of the movable coil 14 (the amount of the slide/movement will be hereinafter referred to as the "shift amount") to adjust the inductance of the loading coil portion, allowing the antenna (the antenna element of a center loading type) to be tuned to an arbitrary frequency.

Figures 3, 4:
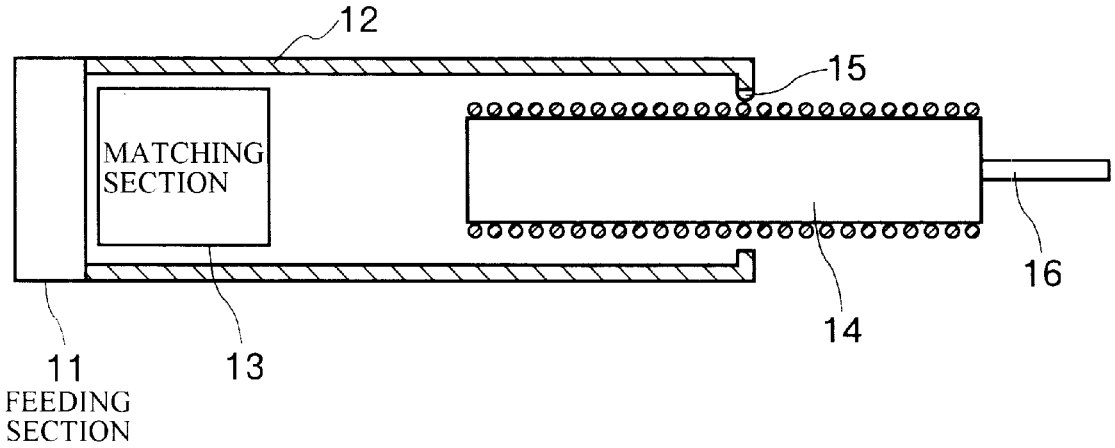
FIG. 3 is a view showing the relationship between a desired tuning frequency and a shift amount of the movable coil.
FIG. 4 is a cross section showing a modification in which the antenna of FIG. 1 has no driving section.

For example, as shown in FIG. 3, the tuning control section 18 prestores a table, bringing the tuning frequency into correspondence with the shift amount (slide amount) of the movable coil 14. The numeric values shown in FIG. 3 are merely samples. The tuning control section 18 controls the driving section 17 according to the table so as to slide the movable coil 14 and to tune the antenna to a target frequency.

As mentioned above, the antenna of this embodiment can tune to a signals having frequencies in the 144 MHz band of the VHF band and signals having a frequencies in the 430 MHz band of the UHF band, in the state wherein the movable coil 14 is held in the holding section 12. Also, the antenna can tune to frequencies which lie in the range extending from the lower limit of the HF band to the upper limit of the 50 MHz region of the VHF band, in accordance with the inductance of that portion of the coil 14 which is located outside of the holding section 12. Thus, the single antenna according to a preferred embodiment of the present invention can tune to signals having frequencies in the HF, VHF, and UHF bands.

In the first embodiment, the tuning control section 18 moves the driving section 17 in accordance with the target frequency. However, other means can be employed for moving the coil 14. For example, as shown in FIG. 4, the driving section 17 can be eliminated, and a user may move the movable coil 14 manually.

Figure 5:
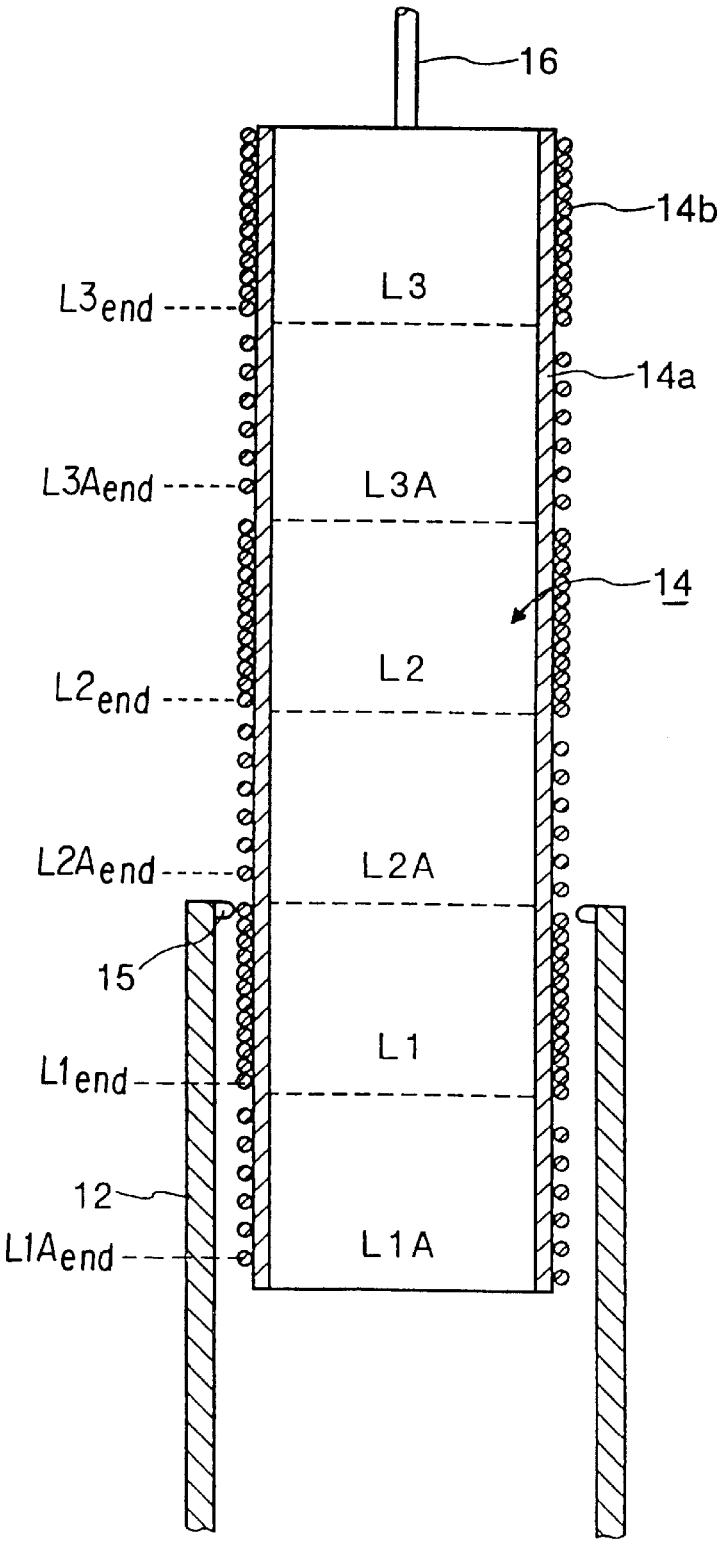
FIG. 5 is a cross section showing a modification of a method for winding the coil of the antenna of FIG. 1.

FIG. 5 shows another embodiment of the present invention. In the embodiments of FIGS. 1, 2, and 4, the winding density of the lead wire 14*b* are uniform. However, a uniform winding density limits the ability to make fine adjustment for the operating frequency. FIG. 5 illustrates another preferred embodiment where the winding density is varied. The term "winding density" is used to describe the proximity of the windings with respect to each other. The higher the winding density, the closer the windings are to one another. If the winding density is small, a large number of turns are needed to obtain the desired inductance for tuning to the antenna to a plurality of signals. Also, if the winding density is small, the movable coil 14 becomes longer. On the other hand, if the winding density is large, the tuning frequency will vary greatly when the movable coil 14 is slid slightly. This makes it difficult to both select the tuning frequency and to finely adjust the coil 14 position to the desired tuning frequency. In contrast, the use of the structure shown in FIG. 5 makes possible for both switching to the tuning frequency band and fine-tuning to the desired tuning frequency. Also, the length of the movable coil 14 will not be too long.

In FIG. 5, the movable coil 14 has the structure wherein the lead wire 14*b* is wound around the bobbin 14*a* such that close winding portions L1, L2, and L3 and rough winding portions L1A, L2A, and L3A are alternately formed. The close winding portions are the portions in which the winding density is high, and the rough winding portions are the portions in which the winding density is low. With this structure, the close winding portions L1, L2, and L3 are used to switch between the frequency bands by varying the inductance. Also, the rough winding portions L1A, L2A, and L3A can finely tune to the desired frequency.

As an example, the desired operation frequencies lies within a low frequency band F1, an intermediate frequency band F2 and a 50 MHz band F3. The bands F1 and F2 are included in the HF band, while the band F3 is included in the VHF band. In this case, the close coil L3 is wound so that its tuning frequency is equal to the upper limit of the frequency band F3 when its end $L3_{end}$ contacts the contacting section 15. The rough coil L3A is wound so that its tuning frequency is equal to the lower limit of the frequency band F3 when its end $L3A_{end}$ contacts the contacting section 15.

Likewise, the close coil L2 is wound so that its tuning frequency is equal to the upper limit of the frequency band F2 when its end $L2_{end}$ contacts the contacting section 15. The rough coil L2A is wound so that its tuning frequency is equal to the lower limit of the frequency band F2 when its end $L2A_{end}$ contacts the contacting section 15. Further, the close coil L1 is wound so that its tuning frequency is equal to the upper limit of the frequency band F1 when its end $L1_{end}$ contacts the contacting section 15. The rough coil L1A is wound so that its tuning frequency is equal to the lower limit of the frequency band F1 when its end $L1A_{end}$ contacts the contacting section 15.

According to the above example, the movable coil 14 is slid in the state wherein the contacting section 15 contacts the rough winding coil L3A. Thereby, the inductance of the movable coil 14 can be delicately changed, and the tuning frequency can be finely adjusted in the band F3. Similarly, the movable coil 14 is slid in a state in which the contacting section 15 contacts the rough winding coil L2A. Thereby, the inductance of the movable coil 14 can be delicately changed, and the tuning frequency can be finely adjusted in the band F2. Further, the movable coil 14 is slid in a state in which the contacting section 15 contacts the rough winding coil L1A. Thereby, the inductance of the movable coil 14 can be delicately changed, and the tuning frequency can be finely adjusted in the band F1.

Also, by sliding the movable coil 14 to a certain degree, the band of tuning frequencies can be switched between the bands F1, F2 and F3. In the above example, the tuning frequency band is switched between three bands. However, the number of bands is not limited to three, and may be two or four or more. For example, in the case of tuning to the 3.5 MHz, 7 MHz, 14 MHz, 21 MHz, 28 MHz and 50 MHz bands, six pairs of close winding and rough winding portions may be formed since the number of tuning frequency bands is six.

Figure 6:
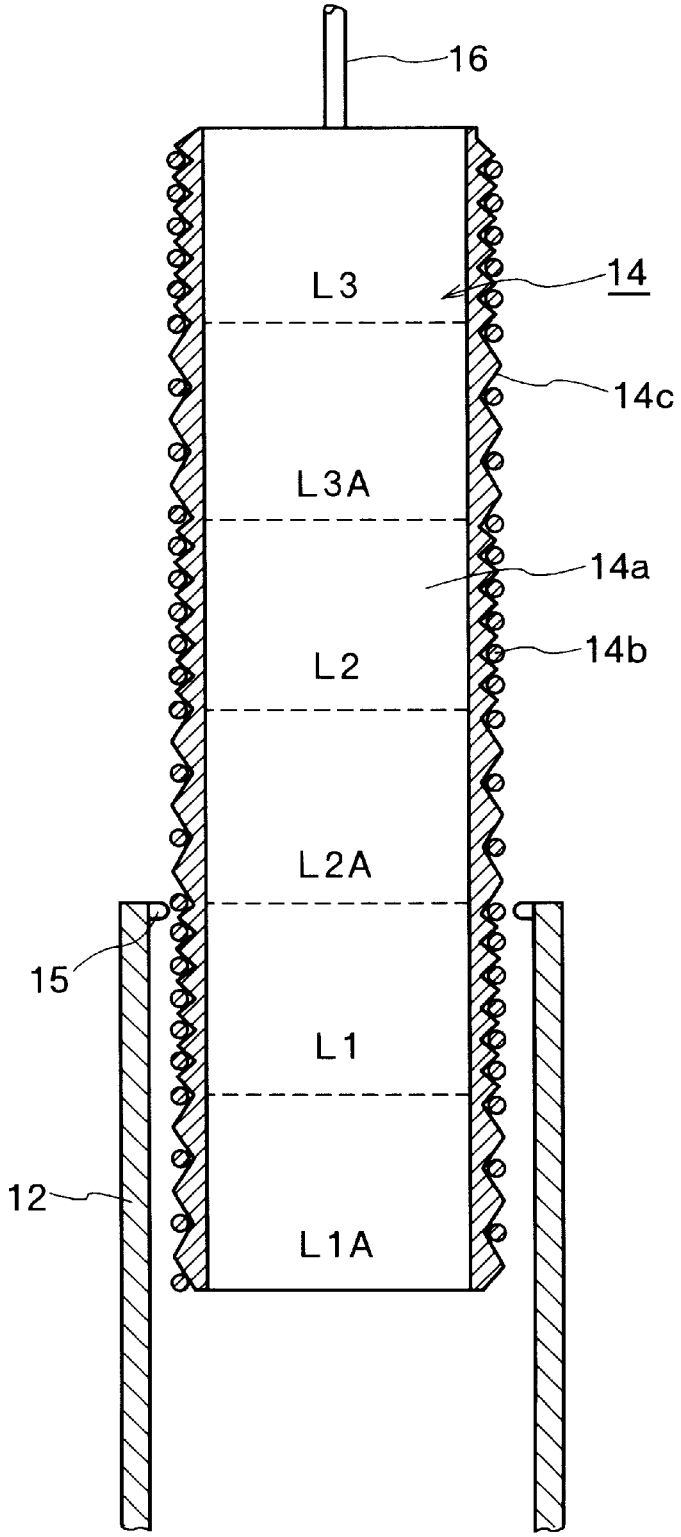
FIG. 6 is a cross section showing a modification of the antenna of FIG. 5 in which a groove for a wire winding is formed on a bobbin.

In the structure shown in FIGS. 1, 2, 4, and 5, the lead wire 14*b* is wound around a flat surface bobbin 14*a*. The shape of the bobbin 14*a* and the winding method of the wire 14*b* may be varied. For example, as shown in FIG. 6, grooves 14*c* may be formed on the bobbin 14*a* and one lead wire 14*b* can be wound along the grooves 14*c*. According to this structure, the lead wire 14*b* can be easily wound around the bobbin 14*a*. The diameter of the movable coil 14 may be substantially uniform.

In the structure shown in FIGS. 1, 4, 6, the contact portion between the contacting section 15 and the movable coil 14 is a point contact. Consequently, in the case where the tuning frequency is high (e.g., the 28 MHz band or the 50 MHz band), the receiving frequency may be shifted and a spurious wave may be generated due to the influence of that portion of the coil 14 which is held in the holding section 12. Also, there is a problem in mechanical strength.

Figure 7:
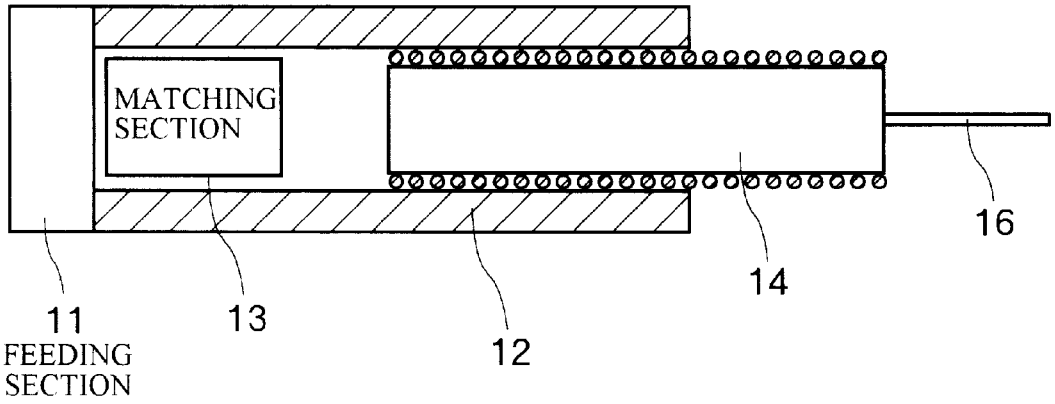
FIG. 7 is a cross section showing a modification of the antenna of FIG. 5 in which a groove for a wire winding is formed on a bobbin.

In order to solve the above problems, the following structure may be used. Specifically, as shown in FIG. 7, the inner diameter of the holding section 12 is conformed to the outline of the movable coil 14 such that the entirety of that portion of the coil 14 which is held in the holding section 12 is in contact with the inner surface of the holding section 12. With this structure, the entirety of that portion of the coil 14 which is held in the holding section 12 is in contact with the inner surface of the holding section 12. As compared to the case (point contact) wherein the movable coil 14 and the holding section 12 contacts each other only at the contacting section 15, the movable coil 14 and the holding section 12 are more reliably in contact with each other. Moreover, since the movable coil 14 is supported by the entire holding section 12, the mechanical strength is improved as compared to the case of the point contact. In FIG. 7, though the holding section 12 contacts the movable coil 14 and supports it, a coil guide may be attached to the inner surface of the holding section 12. The coil guide contacts the movable coil 14 and supports it.

Next, an example of the structure of the driving section 17 shown in FIG. 1 will be explained with reference to FIG. 8. The driving section 17 comprises a motor 71, a separator 72, and a lead screw 73. The motor 71 is supported by the separator 72, and is rotated by power supplied from an outside power source. The separator 72 is fixed to the holding section 12, and secures the motor 71 to an end portion of the holding section 12. The lead screw 73 is directly coupled to the rotary shaft of the motor 71, and is fitted into the lead nut 14*d* formed in the bobbin 14*a*. The lead nut 14*d* is moved by the rotation of the lead screw 73.

According to the above embodiment, if the motor 71 is rotated in one direction, the lead screw 73 rotates and an upward force is applied to the lead nut 14*d* into which the lead screw 73 is fitted. Then, the bobbin 14*a* moves upward according to the rotation of the motor. Also, if the motor 71 is rotated in the other direction, the lead screw 73 rotates and a downward force is applied to the lead nut 14*d*. Then, the bobbin 14*a* moves downward according to the rotation of the motor. The movable coil 14 can be slightly slid by controlling the angle of rotation of the motor, and the tuning frequency of the antenna can be correctly conformed to the target frequency.

Figure 8:
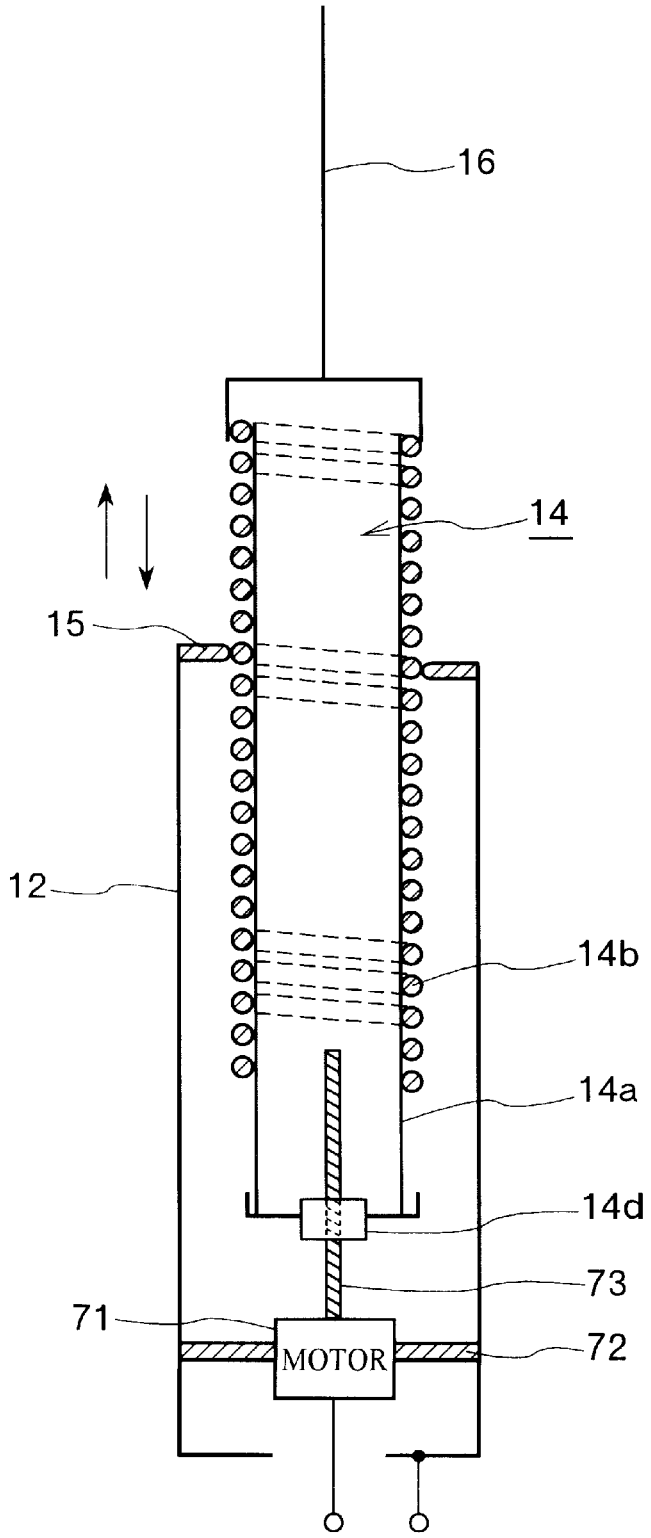
FIG. 8 is a view showing one example of the structure of the driving section that slides the movable coil by rotating the movable coil.
Figure 9:
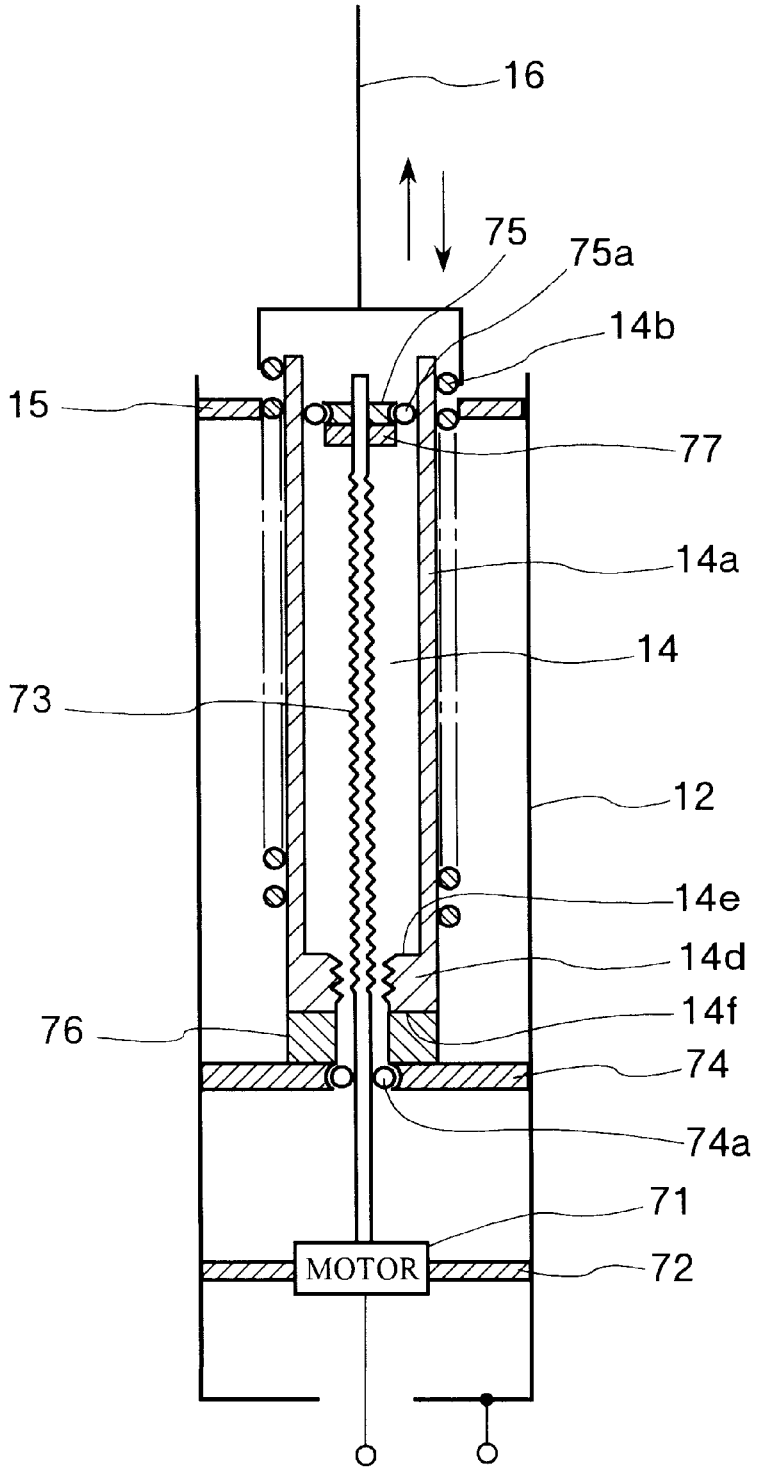
FIG. 9 is a view showing an antenna structure having a mechanism for restricting a coil's slide range.

FIG. 9 shows a modification of the driving section 17 of FIG. 8. The driving section 17 comprises the motor 71, the separator 72, the lead screw 73, axial supports 74, 75, a lower stopper 76, and an upper stopper 77. The motor 71 is supported by the separator 72, and is rotated by a drive signal sent from an outside unit. The separator 72 is fixed to the holding section 12, and secures the motor 71 to an end portion of the holding section 12. The lead screw 73 is directly coupled to the rotary shaft of the motor 71, and fitted into the lead nut 14d formed in the bobbin 14*a*. The lead nut 14*d* is moved by the rotation of the lead screw 73. The axial support 74 supports the rotary shaft of the motor 71 through a bearing 74*a*. The axial support 75 is secured to the top of the lead screw 73, supports the inner surface of the bobbin 14*a* through the bobbin 14*a*, thereby holding the lead screw 73.

The lower stopper 76, which is made of elastic material such as rubber, is secured to the axial support 74. The lower stopper 76 is one for stopping the downward movement of the bobbin 14*a* by way of abutting against the lower end of the bobbin 14*a*. The upper stopper 77 is attached to the tip portion of the lead screw 73. The upper stopper 77 is one for stopping the upward movement of the bobbin 14*a* by way of abutting against the inner bottom of the bobbin 14*a* (the upper surface of the lead nut 14*d*).

According to the above embodiment, if the motor 71 is rotated in one direction, the lead screw 73 rotates, and an upward force is applied to the lead nut 14*d* into which the lead screw 73 is fitted. The bobbin 14*a* moves upward according to the rotation of the motor, and stops moving upward when the inner bottom 14*e* of the bobbin 14*a* abuts against the upper stopper 77. Also, if the motor 71 is rotated in the other direction, a downward force is applied to the lead nut 14*d*. The bobbin 14*a* moves downward according to the rotation of the motor, and stops moving downward when the lower end 14*f* of the bobbin 14*a* abuts against the lower stopper 76.

According to the above-explained structure, unlike in the case of the structure shown in FIG. 8, the movement of the bobbin 14*a* is limited in a fixed distance. Also, due to the axial supports 74 and 75 being employed, the strength of the entire antenna is improved.

Figure 10:
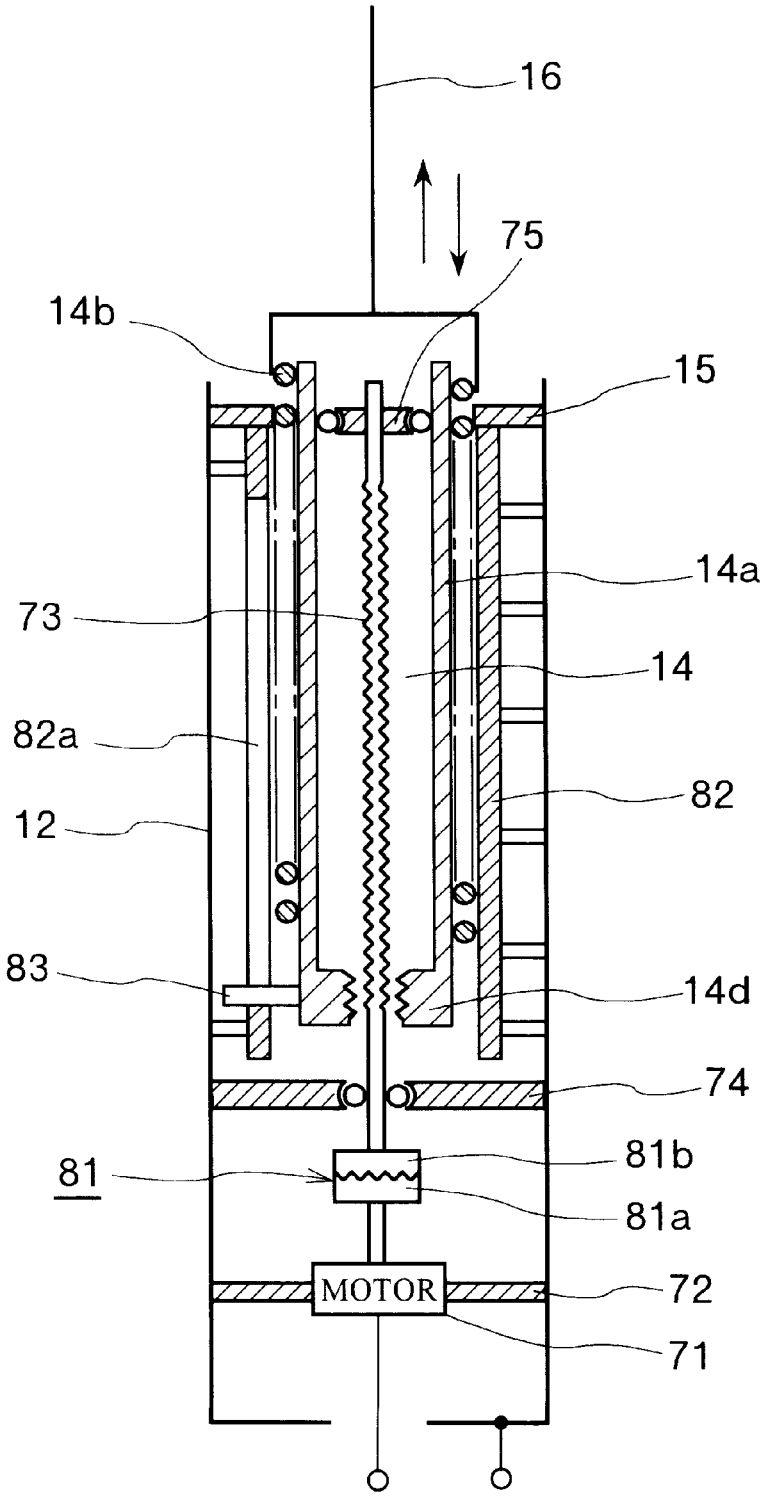
FIG. 10 is a view showing an antenna structure having a mechanism for restricting the movable coil's slide range, and a clutch for preventing an overload of a motor.

In the structure of FIG. 9, the lead screw 73 is directly coupled to the motor 71. Even if the lead nut 14*d* of the bobbin 14*a* reaches an upper dead point or a lower dead point, the motor 71 continues rotating. As a result, in some cases, an overload may be applied to the motor 71. FIG. 10 shows the structure of the driving section 17 in which the foregoing problem is overcome. In FIG. 10, the driving section 17 comprises the motor 71, the separator 72, the lead screw 73, the axial support 74, a clutch 81, a coil guide 82, and a guide pin 83.

The clutch 81 comprises a pair of clutch plates 81*a* and 81*b*. One clutch plate 81*a* is attached to the rotary shaft of the motor 71, and the other clutch plate 81*b* is attached to the lead screw 73. In the normal state, the clutch plates 81*a* and 81*b* are engaged with each other, and a rotational force applied to the clutch plate 81*a* is transmitted to the clutch 81*b*. As a result, the rotational force of the motor 71 is transmitted to the lead screw 73 so that the coil 14 moves up and down. However, when the force between the clutch plates 81*a* and 81*b* reaches more than the defined value, the clutch plates 81*a* and 81*b* become disengaged from each other, and accordingly no rotation force is transmitted.

The movable coil 14 is cylindrically formed. Also, the movable coil 14 is secured to the inner portion of the holding section 12. The movable coil 14 is supported by substantially the entire inner surface of the holding section 12. As in the case of the holding section 12 illustrated in FIG. 7, the coil guide 82 may short the entire wire 14*b* held in the holding section 12. The coil guide 82 has a slit 82*a* along its long axis. The guide pin 83 is positioned at a lower side end of the bobbin 14*a* to be inserted into the slit 82*a* formed on the coil guide 82.

According to the above-structured antenna, when the motor 71 rotates in one direction, the rotational force is transmitted to the lead screw 73 through the clutch 81. By the rotation of the screw 73, a force is applied to the lead nut 14*d*, and the movable coil 14, for example, moves up and down. At this time, though not only upward and downward forces but the rotational force is applied to the lead nut 14*d*. However, the rotation of the movable coil 14 is prevented since the guide pin 83 is inserted into the slit 82*a*.

When the guide pin 83 reaches the upper end (upper dead point) of the slit 82*a*, the movable coil 14 cannot move, and the force more than the defined value is applied between the clutch plates 81*a* and 81*b*. As a result, the clutch plates 81*a* and 81*b* become disengaged from each other, and the force is not transmitted from one clutch plate 81*a* to the other clutch plate 81*b*.

When the motor 71 rotates in the other direction, this rotation is transmitted to the lead screw 73 through the clutch 81 so that the movable coil 14, for example, moves downward. When the guide pin 83 reaches the lower end (lower dead point) of the slit 82*a*, the movable coil 14 cannot move, and the force more than the defined value is applied between the clutch plates 81*a* and 81*b*. As a result, the clutch plates 81*a* and 81*b* become disengaged from each other, and the force is not transmitted from one clutch plate 81*a* to the other clutch plate 81*b*.

As explained above, according to the antenna of FIG. 10, when a force more than the fixed value is applied to the guide pin 83, the clutch plates 81*a* and 81*b* are separated from each other. Therefore, the movable coil 14 can be stopped without applying an overload to the motor 71.

The formation of the coil guide 82 results in an increase in the contact area between the holding section 12 and the movable coil 14, and ensures stable operation. Also, due to the increase in the contact area, the mechanical strength is improved. Moreover, this structure eliminates the bounding influence between the inner-coils at the contacting section 15. Further, since the effective area of the holding section 12 is large, the available frequency range is increased.

Figure 11:
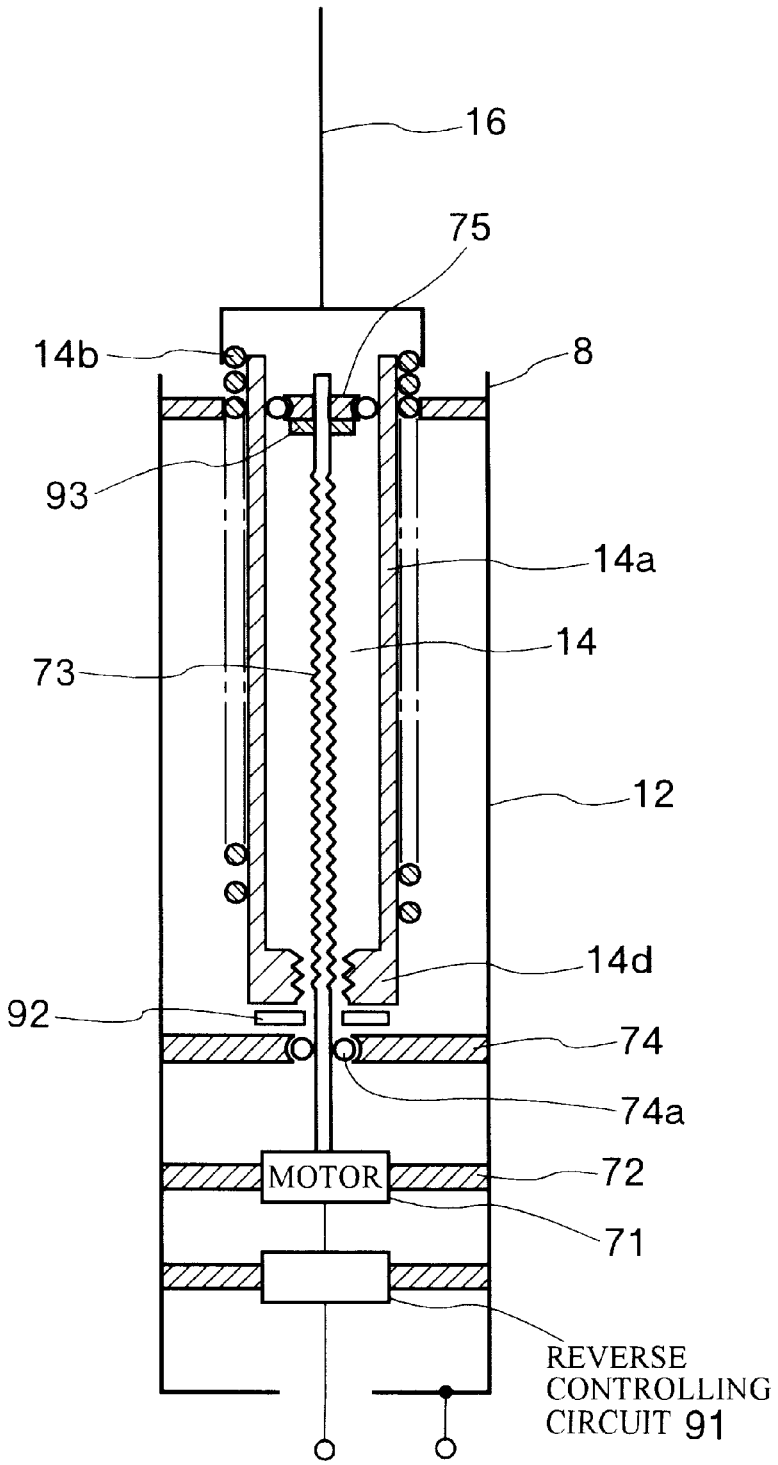
FIG. 11 is a view showing an antenna structure having a mechanism that changes the movable coil slide direction when the coil reaches an end of a range the movable coil's slide range.
Figure 12:
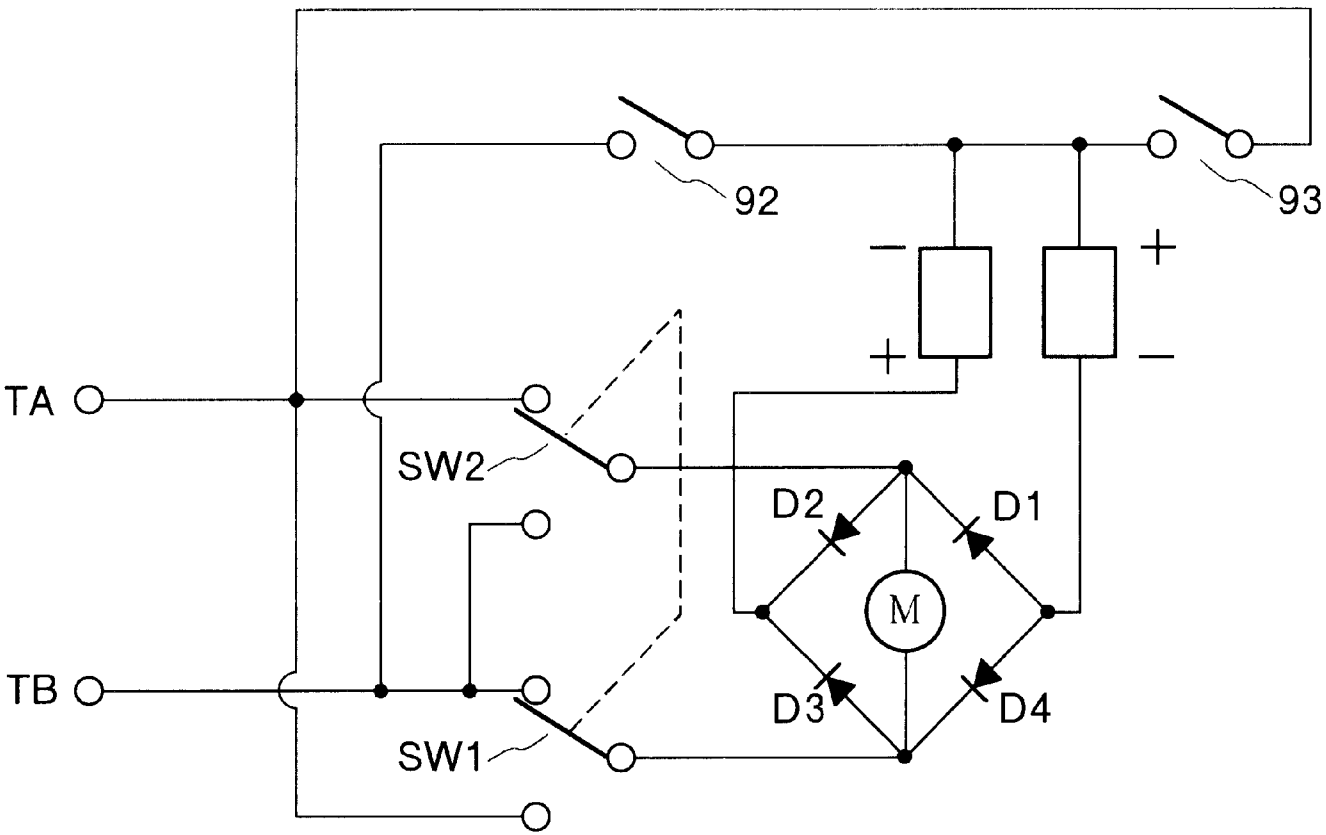
FIG. 12 is a view showing a circuit diagram of a rotation controlling section of FIG.

In the structure of FIG. 10, though overload is prevented from being applied to the motor 71, the rotation of the motor 71 is not stopped. In consideration of this problem, FIGS. 11 and 12 show an antenna in which the motor 71 is reversely rotated to automatically reverse the slide direction of the coil 14 when the movable coil 14 reaches the upper or lower dead point. As shown in FIG. 11, the motor 71 and a reverse controlling circuit 91 are arranged in the holding section 12. Also, a stopper switch 92 is positioned at the tip of the lead screw 73, and a stopper switch 93 is placed at the root of the lead screw 73. According to this above structure, unlike in the case of the structure illustrated in FIG. 8, the movement of the bobbin 14*a* is limited within a fixed distance. Also, the presence of the axial supports 74 and 75 result in an improvement in the strength of the entire antenna.

FIG. 12 is a circuit diagram of the reverse controlling circuit 91. As shown in the figure, the circuit 91 comprises a bridge rectifying circuit, switches 92 and 93, and a double wire type latching relay. The bridge rectifying circuit is connected to the motor and has diodes D1 to D4.

The latching relay comprises a setting coil S, a resetting coil R and switches SW1 and SW2. The coil S sets the switches SW1 and SW2 (i.e., brings the movable arm of the switches SW1 and SW2 into contact with setting terminals) when a current flows from its "+" electrode to its "−" electrode. The coil R resets the switches SW1 and SW2 (i.e., brings the moveable arm into contact with resetting terminals) when a current flows from its "+" electrode to its "−" electrode.

When "+" and "−" voltages are applied to terminals TA and TB, respectively, in the state shown in FIG. 12, a current $I_1$ flows to the motor M(71), and the motor rotates in one direction, and the movable coil 14, moves upward, for example. During this movement, when the inner bottom of the bobbin 14*a* touches the stopper switch 93, the switch 93 turns ON. Then, the current flows to the terminal TB from the terminal TA through the stopper switch 93, the setting coil S, the diode D4, and the switch SW2. Since the current flows to the setting coil S, the movable arms of the switches SW1 and SW2 are brought into contact with the setting terminals. Therefore, a current $-I_1$ flows to the motor 71, the motor 71 is reversely rotated, and the movable coil 14 moves downward.

When the lower end of the bobbin 14*a* touches the stopper switch 92, the switch 92 turns ON. Then, the current flows to the terminal TB from the terminal TA through the diode D3, the resetting coil R, and the stopper switch 92. Since the current flows to the resetting coil R, the movable pieces of the switches SW1 and SW2 are brought into contact with the resetting terminals. Consequently, the current $I_1$ flows to the motor 71 again, the motor 71 is rotated to the original direction, and the movable coil 14 moves upward.

If the "−" and "+" voltages are applied to the terminals TA and TB, respectively, under the circuit condition illustrated in FIG. 12 and after the power is turned off during the upward movement of the movable coil 14, the motor 71 is reversely rotated and the bobbin 14*a* moves down. According to the structure of this embodiment, the movable coil 14 contacts the stopper switch 92 or 93. Thereafter, the rotational direction of the motor 71 is changed, and the moving direction of the coil 14 is changed within a short period of time. Therefore, no overload is applied to the motor 71 or the stopper switches 92 and 93.

Figure 13:
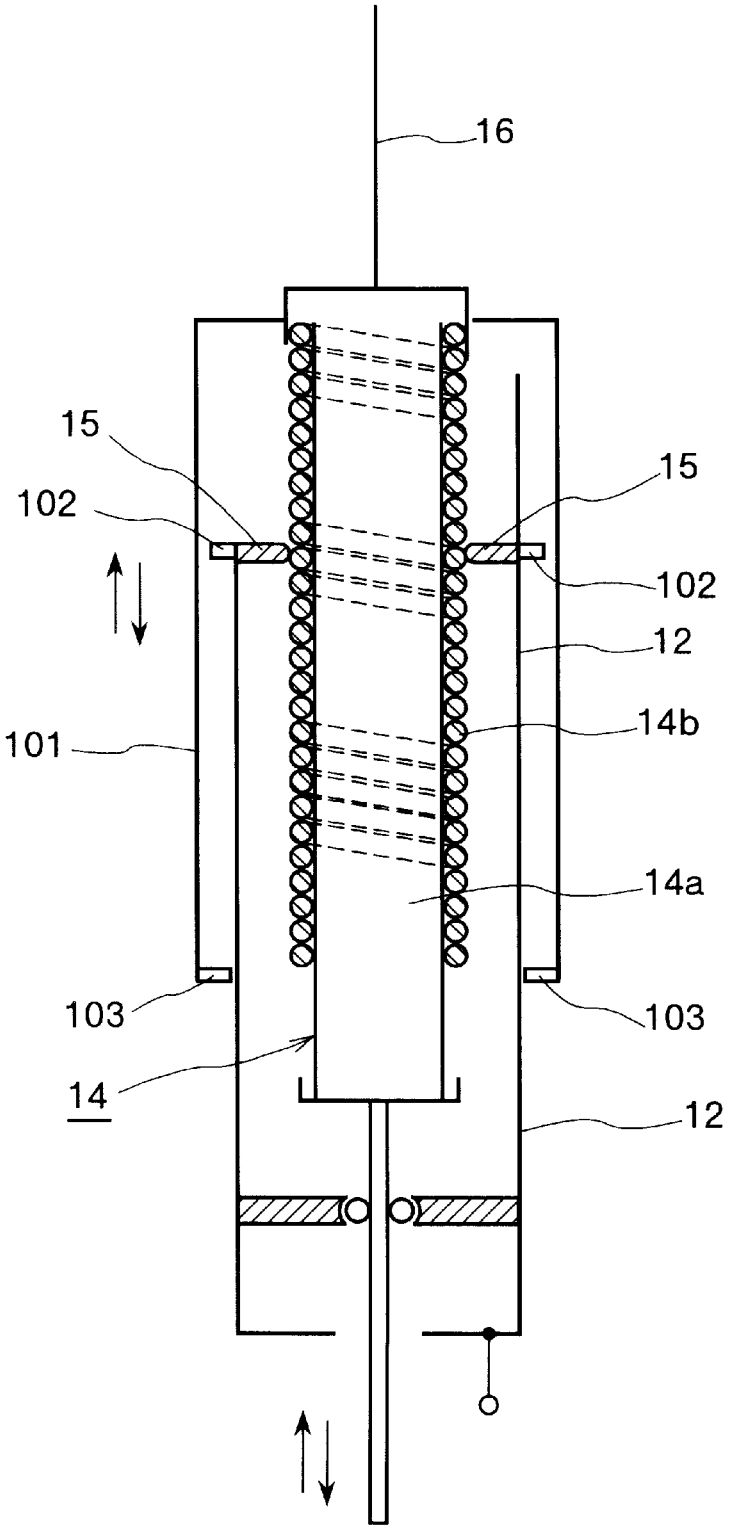
FIG. 13 is a view showing an antenna structure having a waterproof mechanism.

In the case of using each of the above-explained antennas outside, it is preferable that a structure for protecting the antenna from water be employed. In consideration of this point, FIG. 13 shows the main part of an example of an antenna having a waterproof structure. As shown in the figure, the antenna has a structure in which a waterproof pipe 101 and stoppers 102 and 103 are added to the antenna comprising the holding section 12, the movable coil 14, and the rod 16.

The waterproof pipe 101 is secured to the bobbin 14*a* and the rod 16 to cover the holding section 12. The stopper 102 is formed on the upper end of the holding section 12 to be projected therefrom. The stopper 103 is formed on the lower end of the waterproof pipe 101 so as to be substantially in contact with the outer face of the holding section 12. When the movable coil 14 moves up and down, the waterproof pipe 101 also moves, so that the stopper 103 slides on the outer face of the holding section 12. Thus, fine dust and rainwater are prevented from entering the holding section 12 and the movable coil 14.

Figure 14:
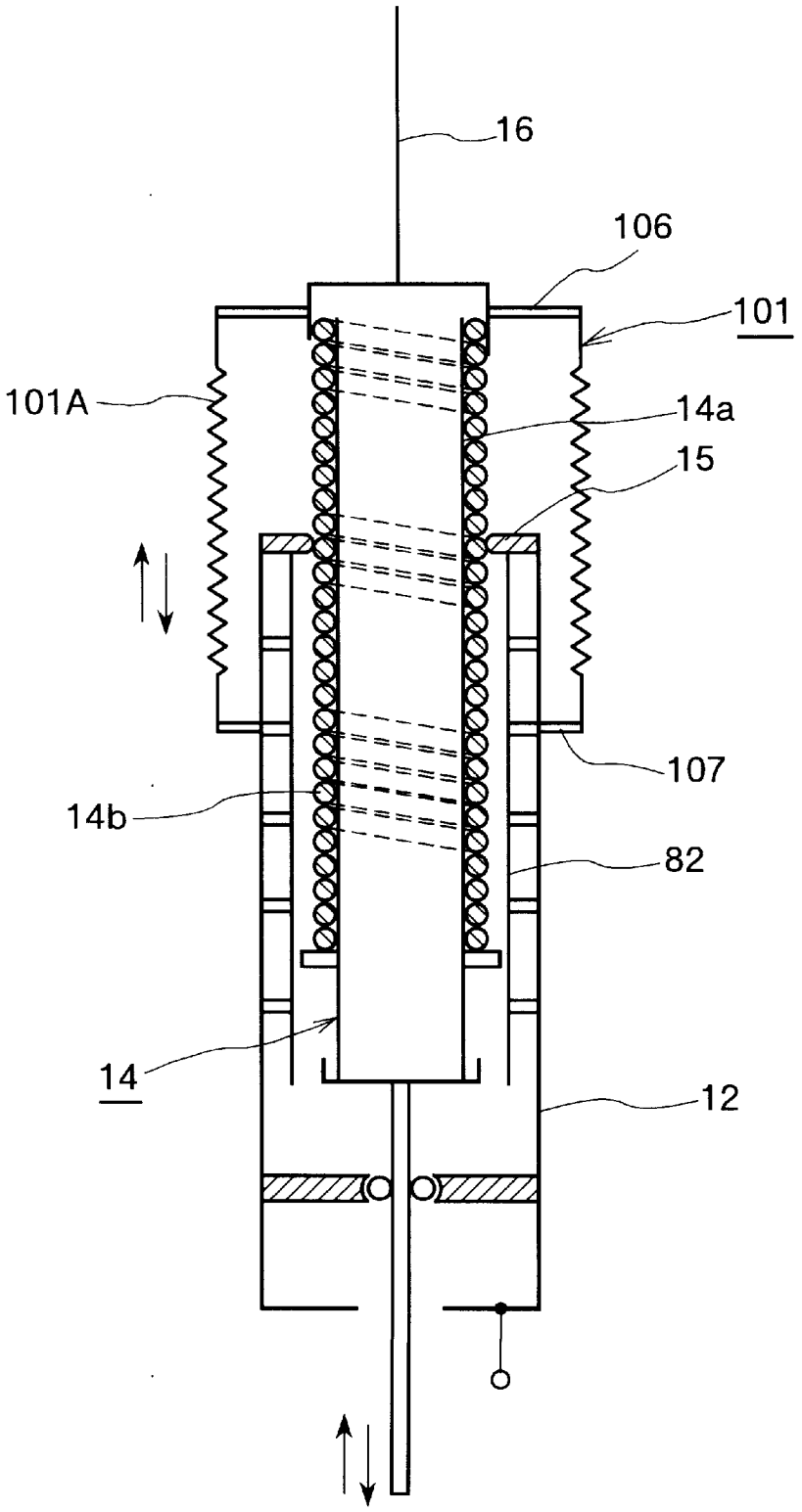
FIG. 14 is a view showing an antenna structure having a waterproof mechanism dissimilar to the waterproof mechanism shown in FIG. 13.

If the structure of FIG. 13 is improved as shown in FIG. 14, fine dust and rainwater can be more effectively prevented from entering them. In the structure of FIG. 14, the waterproof pipe 101 comprises an extensible bellows portion 101A, a fixing member 106 and a lower fixing portion 107. The fixing member 106 fixes the upper end of the bellow portion 101A to the upper end of the bobbin 14*a*, and the lower fixing member 107 fixes the lower end of the bellow portion 101A to the outer side surface of the holding section 12.

The bellow portion 101A of the waterproof pipe 101 expands in accordance with the movement of the movable coil 14, and no load is applied to the movable coil 14 and the holding section 12. According to this structure, since no gap is generated between the waterproof pipe 101 and the holding section 12, fine dust and rainwater are prevented from entering the holding section 12 and the movable coil 14. FIG. 14 shows the example in which the coil guide 82 is employed. However, the coil guide 82 is not necessary.

Figure 15:
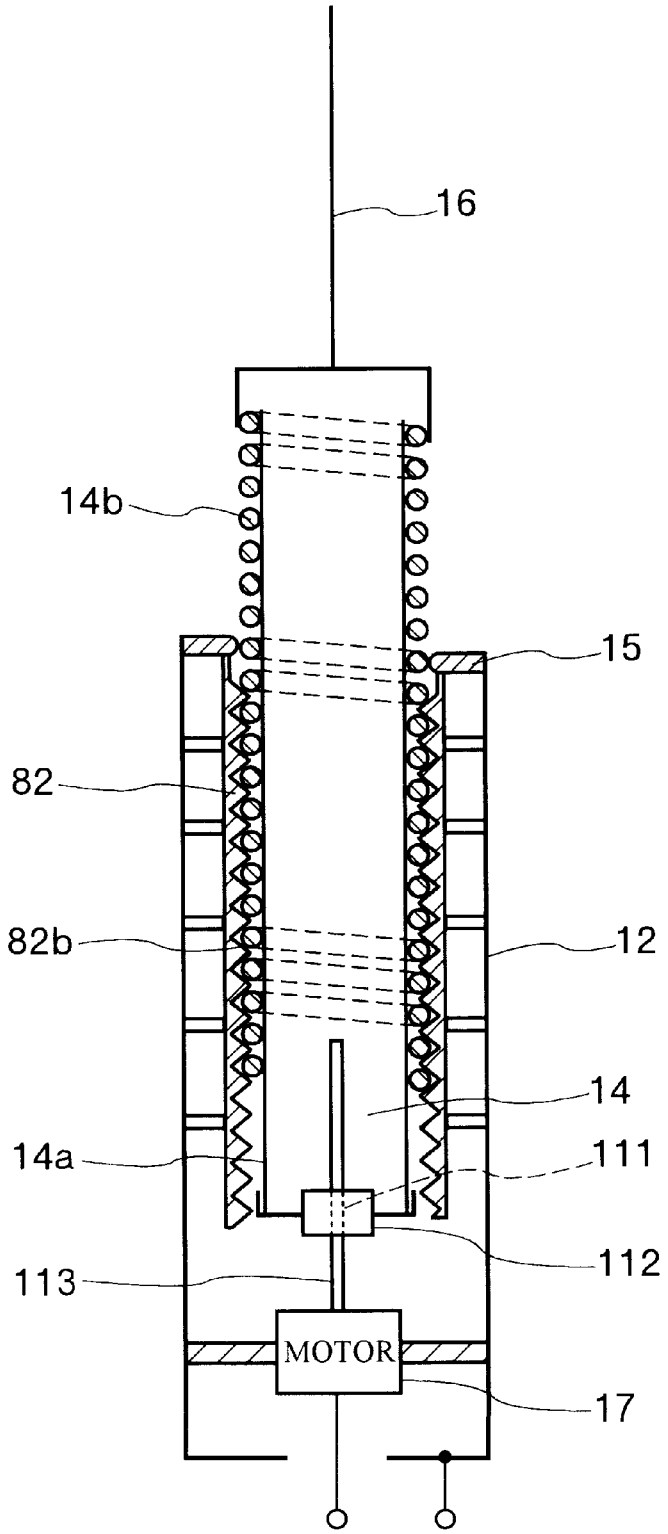
FIG. 15 is a view showing another antenna structure in which the movable coil is slid by rotating the movable coil.

The above embodiments explain the case wherein the movable coil 14 is slid in the holding section 12. However, the movable coil 14 may be slid while being rotated. In FIG. 15, the lead wire 14*b* is wound around the bobbin 14*a* so as to form the movable coil 14. The coil guide 82 is secured to the holding section 12. A spiral groove 82*b*, conforming to the lead wire 14*b*, is formed on an inner surface of the coil guide 82. A guide 112 is attached to the lower end of the bobbin 14*a*. The guide 112 has a through-hole 111 whose cross section is a polygon such as a triangle or a quadrangle. A rotation-transmitting member 113 is inserted into the through-hole 111. The rotation-transmitting member 113 is made of a shaft whose cross section is polygonal. The lower end of the rotation-transmitting member 113 is attached to the rotary shaft of the motor 17.

The rotational force of the motor 17 is transmitted to the movable coil 14 by the rotation-transmitting member 113 and the guide 112 so as to rotate the movable coil 14. Since the spirally wound wire is engaged with the spiral groove 82*b* formed on the coil guide 82, the movable coil 14 slides in its long axial direction according to the rotational direction of the coil 14. In other words, by changing the rotational direction of the motor 17, the movable coil 14 can be slid to either the upper or lower direction with the coil 14 being rotated. The coil guide 82 is electrically connected to the holding section 12. The contacting section 15 is formed on an end of the holding section 12. The contacting section 15 is brought into contact with the movable coil 14 by an elastic member such as s spring.

With respect to signals having frequencies in the range extending from the lower limit of (e.g. the 3.5 MHz band included in) the HF band and to the upper limit of a low frequency band (e.g. the 28 MHz or 50 MHz band) included in the VHF band, the above-structured antenna tunes to desired frequencies, depending on the portion of the movable coil 14 which is located outside of the holding section 12, and the wave emitting sections of the rod 16 and the holding section 12. With respect to signals having frequencies in the high frequency band of the VHF band and in the UHF band, the holding section 12 functions as an antenna element, and tunes to these signals.

According to the above structure, the shift amount of the movable coil 14 can be detected from the number of revolutions of the motor 17 and the angle of rotation of the motor 17. As a result, it is possible to know the correct tuning frequency. The number of revolutions of the motor 17 and its angle of rotation are controlled. Thereby, the shift amount of the movable coil 14 can be slightly adjusted, and the tuning frequency can be finely adjusted. Moreover, by virtue of the formation of the coil guide 82, the contact area between the holding section 12 and the movable coil 14 is wide, which ensures a stable operation and a high mechanical strength to the antenna.

In the above embodiments, the holding section 12 tuned to frequencies in the 144 MHz and 430 MHz bands. However, the holding section 12 may be structured to tune to other frequencies. Also, the holding section 12 may be structured to tune to only a single frequency. As another example, the structure for sliding the movable coil 14 may be varies, and is not limited to the illustratively described embodiments.

What is claimed is:

1. An antenna comprising:

a rod;

a coil connected to said rod and forming a loading coil; and a holding section connected to said coil and slidably holding said coil in a plurality of positions;

wherein said holding section functions as an antenna element which tunes to a first frequency, and said rod, said coil and said holding section function as an antenna element of a center loading type and tunes to a second frequency which varies according to the position of said coil.

2. The antenna according to claim 1, wherein:

said rod is used to tune the antenna to a frequency band which ranges from a lower limit of an HF band of radio communication frequencies to an upper limit of a lower frequency range included in a VHF band;

said holding section is formed having a length which is substantially equal to ¼ of a wavelength of a signal whose frequency lies in an upper frequency range included in the VHF band, and which is substantially equal to ⅝ of a wavelength of a signal whose frequency lies in a UHF band;

said antenna functions as a center loading type antenna element which includes said rod, a portion of said coil other than a portion connected to said holding section, and said holding section;

said antenna tunes to the second frequency in the frequency band ranging from the lower limit of the HF band to the upper limit of the low frequency band included in the VHF band; and for higher frequencies, an increased inductance of said coil isolates said rod and said coil so that said holding section functions as an antenna which tunes to the upper frequency range included in the VHF band and to the UHF band.

3. The antenna according to claim 1, further comprising a driving section for sliding said coil according to a tuning frequency.

4. The antenna according to claim 3, further comprising a clutch between said driving section and said coil.

5. The antenna according to claim 3, wherein said driving section has a sensor for defining a sliding range of said coil, and includes means for changing a slide direction of said coil when said coil reaches one end of the sliding range of said coil.

6. The antenna according to claim 3, wherein said driving section slides said coil by rotating said coil.

7. The antenna according to claim 3, wherein said coil is made of a bobbin and a lead wire wound around said bobbin, said holding section has a spiral groove engaging with said lead wire, and said driving section rotates said coil to slide said coil by engagement between said lead wire and said groove.

8. The antenna according to claim 1, wherein:

at least an end portion of said holding section has a contacting section which is in contact with said coil;

a portion of said coil which is located outside of said holding section and that extends from a point at which said contacting section is in contact with said coil forms the loading coil connected to said rod and said holding section; and an inductance of said loading coil changes and the tuning frequency varies when said coil is slid.

9. The antenna according to claim 1, wherein an inner diameter of said holding section is formed to be substantially the same as an outer diameter of said coil, and said coil is in contact with an inner surface of said holding section and slides inside of said holding section.

10. The antenna according to claim 1, wherein said coil comprises a bobbin and a lead wire wound around said bobbin, said lead wire being wound around said bobbin such that a closely wound portion and a roughly wound portion are alternatively formed.

11. The antenna according to claim 1, wherein said coil comprises a bobbin and a lead wire wound around said bobbin, said bobbin having a groove for winding the lead wire, and said lead wire being wound around said bobbin along said groove.

12. The antenna according to claim 1, further comprising means for restricting a sliding range of said coil.

13. The antenna according to claim 1, further comprising a waterproof pipe for covering said holding section.

14. The antenna according to claim 1, further comprising an extensible pipe having two ends, one end being fixed to a first an end of said coil, and the other end being fixed to said holding section.

15. An antenna comprising:

a rod;

a coil connected to said rod; and a cylindrical holding section formed having a size to be tunable to a plurality of frequencies, and slidably holding, and being connected to, at least a part of said coil wherein said holding section functions as an antenna element which tunes to a plurality of first frequencies and said rod, said coil, and said holding section function as an antenna element of a center loading type, and tunes to a plurality of second frequencies that are lower than said first frequencies and that vary according to a position of said coil within said holding section.

16. The antenna according to claim 15, wherein said holding section has a length substantially equal to m times of ⅛ of the wavelength of a first tuning frequency, said holding section has a length substantially equal to n times of ⅛ of the wavelength of a second tuning frequency, m and n being different natural numbers.

17. The antenna according to claim 15, wherein said coil has a roughly wound section and a closely wound section which are alternatively arranged.

18. The antenna according to claim 15, further comprising restricting means for restricting a sliding range of said coil.

19. The antenna according to claim 15, further comprising preventing means for preventing a rotational force more than a fixed amount from being applied to said coil.

20. The antenna according to claim 15, wherein said driving section has a sensor for defining a sliding range of said coil and means for changing a slide direction of said coil when said coil reaches one end of the sliding range of said coil.

21. The antenna according to claim 15, wherein said driving section slides said coil by rotating said coil.

22. The antenna according to claim 15, further comprising means for waterproofing said holding section.

23. A method for tuning an antenna, having a coil connected to a rod and a holding section for holding said coil, to a desired frequency, the method comprising the steps of:

connecting said holding section to said coil in order to tune said antenna to a first frequency, and sliding said coil in said holding section, thereby changing a length of a portion of said coil which is located outside of said holding section, in order to vary an inductance, and thereby a tuning frequency of said coil; and tuning said holding section, functioning as an antenna element, to a second frequency higher than said first frequency such that an increased inductance of said coil isolates said rod and said coil from said holding section.

* * * * *